US007794210B2

(12) United States Patent
Clark et al.

(10) Patent No.: US 7,794,210 B2
(45) Date of Patent: Sep. 14, 2010

(54) TURBOMACHINE BLADE

(75) Inventors: Daniel Clark, Derby (GB); Richard C Harvey, Derby (GB); Jem A Rongong, Stockport (GB)

(73) Assignee: Rolls-Royce plc, London (GB)

( * ) Notice: Subject to any disclaimer, the term of this patent is extended or adjusted under 35 U.S.C. 154(b) by 650 days.

(21) Appl. No.: 11/878,877

(22) Filed: Jul. 27, 2007

(65) Prior Publication Data

US 2008/0025845 A1 Jan. 31, 2008

(30) Foreign Application Priority Data

Jul. 29, 2006 (GB) ..... 0615144.3

(51) Int. Cl.
*B63H 1/26* (2006.01)

(52) U.S. Cl. ..... 416/223 R; 416/229 A; 416/500; 29/889.72

(58) Field of Classification Search ..... 416/144, 416/223 R, 224, 229 R, 229 A, 232, 241 R, 416/241 A, 500; 29/889.71, 889.72
See application file for complete search history.

(56) References Cited

U.S. PATENT DOCUMENTS 6,669,447 B2 * 12/2003 Norris et al. ..... 416/224
7,278,830 B2 * 10/2007 Vetters ..... 416/229 R
7,311,500 B2 * 12/2007 Rongong et al. ..... 416/230
7,329,102 B2 * 2/2008 McMillan et al. ..... 416/229 A
7,594,325 B2 * 9/2009 Read ..... 29/889.71

FOREIGN PATENT DOCUMENTS

| | | |
|---|---|---|
| EP | 1 460 319 A | 9/2004 |
| GB | 1 061 217 SP | 3/1967 |
| GB | 2 071 775 A | 9/1981 |
| GB | 2 371 095 A | 7/2002 |
| GB | 2 391 270 A | 2/2004 |

* cited by examiner

*Primary Examiner*—Igor Kershteyn
(74) *Attorney, Agent, or Firm*—Jeffrey S. Melcher; Manelli Denison & Selter PLLC

(57) ABSTRACT

A turbomachine blade comprising a root portion and an aerofoil portion, the aerofoil portion having a leading edge, a trailing edge, a concave metal wall portion extending from the leading edge to the trailing edge and a convex metal wall portion extending from the leading edge to the trailing edge, the concave metal wall portion and the convex metal wall portion forming a continuous integral metal wall, the aerofoil portion having a hollow interior defined by at least one internal surface, the hollow interior of the aerofoil portion being at least partially filled with a vibration damping material that is separated from the metal wall portions by a thermally insulating material.

15 Claims, 2 Drawing Sheets

TURBOMACHINE BLADE

The present invention relates to a turbomachine blade, for example a compressor blade for a gas turbine engine and in particular to a fan blade for a gas turbine engine.

One known wide chord fan blade comprises a concave metal wall portion, a convex metal wall portion and a honeycomb between the two metal wall portions. This wide chord fan blade is produced by hot forming the wall portions into concave and convex shapes respectively, placing the honeycomb between the metal wall portions and brazing, or activated diffusion bonding, the metal wall portions together around the honeycomb. The interior of the fan blade is evacuated.

Another known wide chord fan blade comprises a concave metal wall portion, a convex metal wall portion and metal walls extending between the two wall portions. Placing a metal sheet between two tapered metal sheets and diffusion bonding the sheets together at predetermined positions to form an integral structure produces this wide chord fan blade. Then inert gas is supplied into the interior of the integral structure to hot form the integral structure into a die to produce the concave and convex walls and the walls extending between the concave and convex walls. The interior of the fan blade is evacuated.

A disadvantage of a wide chord fan blade is that it is not as stiff as a narrow chord fan blade. The reduced stiffness results in an increased risk of stalled flutter within the operating range of the gas turbine engine and an increased susceptibility to other forms of vibration.

One solution to damping the vibrations of a fan blade is to fill the interior with a viscoelastic material core, bonded to the interior of the wall portions, as disclosed in GB2371095, or fill the interior with a stiffening core surrounded by a damping viscoelastic material, as disclosed in EP1460319.

A fan is susceptible to Foreign Object Damage, or FOD. Major damage requires replacement of the blade, but minor damage may be repaired to increase the life of the blade. However, many of the repair techniques require high temperatures which can damage the viscoelastic material and reduce its damping properties.

Accordingly the present invention seeks to provide a novel turbomachine blade that addresses, and preferably overcomes, the above mentioned problems.

Accordingly the present invention provides a turbomachine blade comprising a root portion and an aerofoil portion, the aerofoil portion having a leading edge, a trailing edge, a concave wall portion extending from the leading edge to the trailing edge and a convex wall portion extending from the leading edge to the trailing edge, the concave wall portion and the convex wall portion forming a continuous integral wall, the aerofoil portion having a hollow interior defined by at least one internal surface, the hollow interior of the aerofoil portion being at least partially filled with a vibration damping material having a decomposition temperature and which is separated from the wall portions by a thermally insulating material that inhibits decomposition of the vibration damping material when the blade is subject to a localised heat treatment at a temperature in excess of the decomposition temperature of the vibration damping material.

Preferably the vibration damping material comprises a polymer. The polymer may be a polymer blend comprising Bisphenol A-Epochlorohydrin, an amine hardener and branched polyurethane, or comprise a liquid crystal siloxane polymer.

Preferably the thermally insulating material is yttria or a yttria stabilised Zirconium Oxide. The thermally insulating material may be a layer have has a thickness of between 100 and 500 microns.

Preferably the vibration damping material comprises a damping layer and a stiffer stiffening core, the damping layer being disposed between the thermally insulating material and the stiffening core. Preferably the damping layer is between 0.05 mm and 3.0 mm thick. The damping layer may have a modulus between 0.5 $N/mm^2$ and 100 $N/mm^2$.

A blade may be a compressor blade or a fan blade. The convex and concave metal wall portions preferably comprise titanium or titanium alloy According to a second aspect of the invention there is provided a method of manufacturing a turbomachine blade from at least two metal workpieces comprising the steps of:—

(a) forming at least two metal workpieces, (b) applying stop off material to a predetermined area of a surface of at least one of the at least two metal workpieces, (c) arranging the workpieces in a stack such that the stop off material is between the at least two metal workpieces, (d) heating and applying pressure across the thickness of the stack to diffusion bond the at least two workpieces together in areas other than the preselected area to form an integral structure, (e) heating and internally pressurising the interior of the integral structure to hot form the at least two metal workpieces into an aerofoil shape to form a turbomachine blade having a hollow interior defined by at least one internal surface, (f) supplying vibration damping material into the hollow interior of the turbomachine blade and bonding the vibration damping and stiffening system to the stop off material, and (g) sealing the hollow interior of the turbomachine blade.

Preferably the stop off material is yttria or yttria stabilised Zirconia Oxide.

Preferably the stop off is a layer having a thickness of between 100 and 500 microns. More preferably the thickness is greater than 200 microns.

The present invention will be more fully described by way of example with reference to the accompanying drawings in which:—

Figure 1:
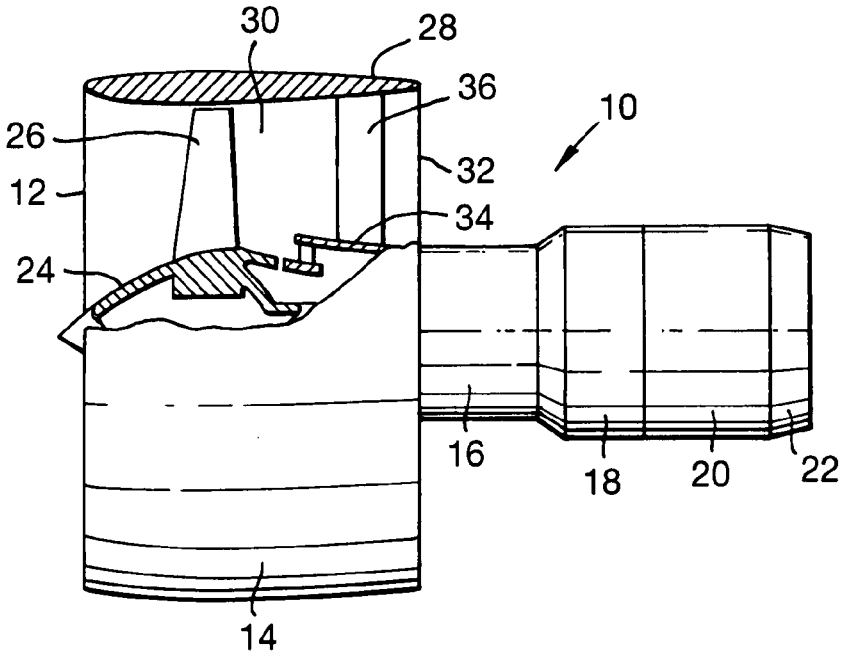
FIG. 1 shows a gas turbine engine having a blade according to the present invention.

A turbofan gas turbine engine 10, as shown in FIG. 1, comprises in axial flow series an inlet 12, a fan section 14, a compressor section 16, a combustion section 18, a turbine section 20 and an exhaust 22. The fan section 14 comprises a fan rotor 24 carrying a plurality of equi-angularly-spaced radially outwardly extending fan blades 26. A fan casing 28 that defines a fan duct 30 surrounds the fan blades 26 and the fan duct 30 has an outlet 32. The fan casing 28 is supported from a core engine casing 34 by a plurality of radially extending fan outlet guide vanes 36.

The turbine section 20 comprises one or more turbine stages to drive the compressor section 18 via one or more shafts (not shown). The turbine section 20 also comprises one or more turbine stages to drive the fan rotor 24 of the fan section 14 via a shaft (not shown).

Figure 2:
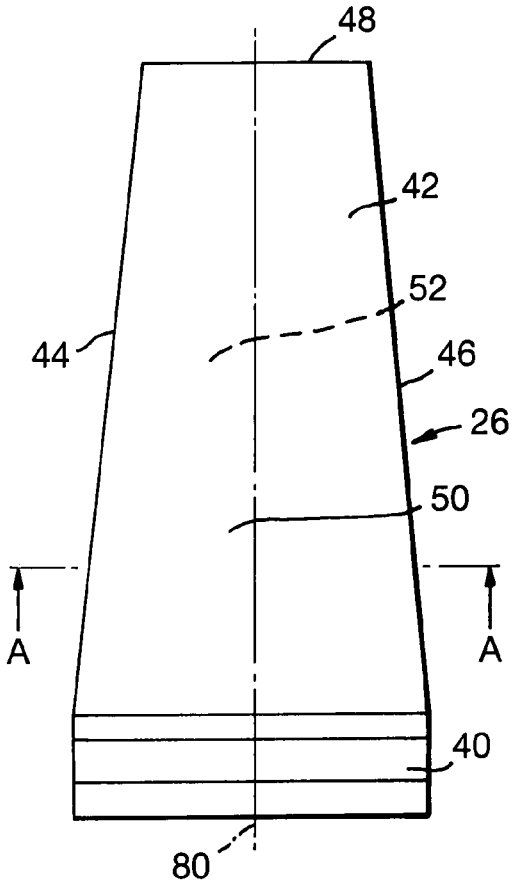
FIG. 2 is an enlarged view of a fan blade according to the present invention.
Figure 3:
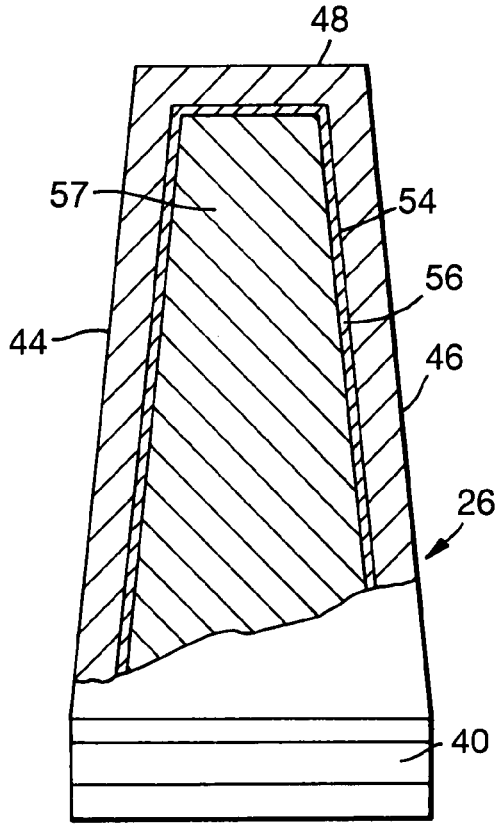
FIG. 3 is a cut away view through the fan blade shown in FIG. 2.
Figure 4:
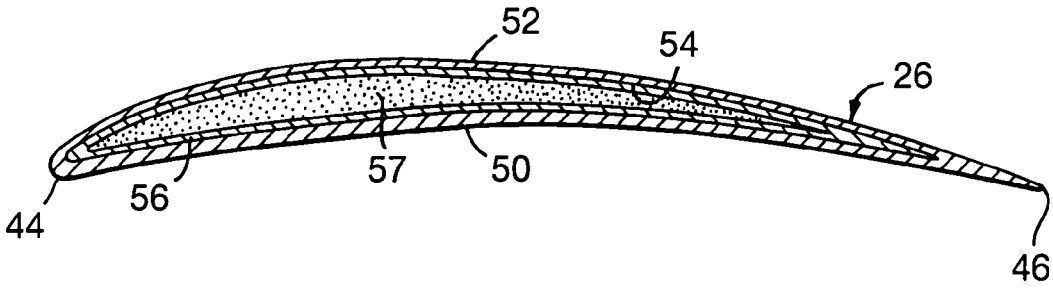
FIG. 4 is a cross-sectional view in the direction of arrows A-A in FIG. 2.

One of the fan blades 26 is shown in more detail in FIGS. 2, 3 and 4. The fan blade 26 comprises a root portion 40 and an aerofoil portion 42. The root portion 40 comprises a dovetail root, a firtree root, or other suitably shaped root for fitting in a correspondingly shaped slot in the fan rotor 26, or for mounting to a disk to form a blisk by linear friction welding or other appropriate method. The aerofoil portion 42 has a leading edge 44, a trailing edge 46 and a tip 48. The aerofoil portion 42 comprises a concave wall 50, which extends from the leading edge 44 to the trailing edge 46, and a convex wall 52 that extends from the leading edge 44 to the trailing edge 46. The concave and convex walls 50 and 52 respectively comprise a metal for example a titanium alloy. The aerofoil portion 42 has an interior surface 54 and at least a portion, preferably the whole, of the hollow interior 54 of the aerofoil portion 42 is filled with a vibration damping system 56, 57.

The damping material 57 is a relatively low shear modulus material having viscoelasticity. Viscoelasticity is a property of a solid or liquid which when deformed exhibits both viscous and elastic behaviour through the simultaneous dissipation and storage of mechanical energy. Suitable materials for the damping layer 57 comprise a polymer blend, a structural epoxy resin and liquid crystal siloxane polymer.

One particular and preferred polymer blend comprises, per 100 grams: 62.60%. Bisphenol A-Epochlorohydrin (Epophen resin EL5▩ available from Borden Chemicals, UK); 17.2 grams Amine hardener (Laromin C260▩ available from Bayer, Germany); 20.2 grams of branched polyurethane (Desmocap 11▩ available from Bayer, Germany). This polymer blend is then mixed in a mass ratio of 1:1 with a structural epoxy resin, preferably Bisphenol A-Epochlorohydrin mixed with an amine-terminated polymer (e.g. Adhesive 2216▩ available from 3M).

It is desirable for the damping layer 62 to comprise a modulus of elasticity in the range 0.5-100 MPa and the modulus of elasticity of the core 64 to be above 200 MPa, but preferably at least 500 MPa and as much as 10000 MPa. For the polymer blend damping layer, described above, the modulus is approximately 10 MPa and a Poisson's ratio of approximately 0.45 and for the core (Epocast 1637▩) 700 MPa and 0.40 respectively.

The viscoelastic material allows the component to withstand high levels of vibration, but typically cannot withstand temperatures higher than about 200° C. without suffering from decomposition. For a fan aerofoil or compressor aerofoil, which typically run at temperatures below this figure the viscoelastic material will not thermally decompose.

Modern blades are complex and expensive to produce which makes repair economical. It is difficult to remove viscoelastic material from blades once they have been formed and it is preferable to repair the blades with the damping material in-situ. For a titanium blade, which is the typical material used in a compressor blade, a repair typically involves welding.

Figure 5:
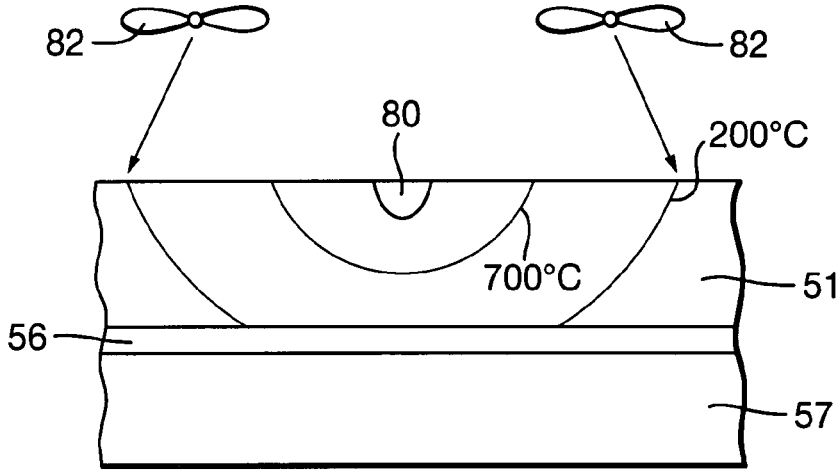
FIG. 5 depicts isotherms in a repaired blade during repair.

In FIG. 5 typical isotherms within a blade repair are depicted. The repair 80 is applied to the surface of the metal 51 of the aerofoil. The temperature of the repair 80, which has a width of 1-2 mm and can have a significant length in excess of 20 mm, is of the order 1600° C. Isotherms at 700° C. and 200° C. are shown within the blade. Fans 82 blow over the surface of the blade to remove the inputted heat from the blade. The thermal barrier coating 56 has a thickness between 150 and 250 microns and prevents the high temperatures produced during the welding process passing through to the damping material 57 avoiding damage.

Additionally the weld generates stresses in the blade through thermal contraction against the restraint of the cooler relatively stiff blade substrate. The weld is heat treated to reduce the intensity of the stresses. Such heat treatment typically occurs at temperatures of the order 550° C., which is above the decomposition temperature of the viscoelastic damper 57 and occasionally at a temperature up to 700° C.

The heat treatment is performed locally i.e. in the region of the blade which is to be repaired. The region can extend up to 30 mm from the repair point. To relieve stress it is necessary to hold the local temperature at the blade surface above the decomposition temperature of the viscoelastic damper for up to two hours.

In accordance with the invention the thermal barrier coating or insulator 56 provided on the internal surface 54 of the metal portion of the blade 26 between the metal and the viscoelastic damping material 57 limits the transfer of heat to the damping material and maintains its temperature below its decomposition temperature.

The thermal barrier coating adheres to both the damping material 57 and the blade internal wall 54.

In an alternative construction the vibration damping system also comprises a stiffening system within the hollow interior, the vibration damping and stiffening system 56 comprising varying material properties, which are arranged to both damp vibrations and provide the blade with increased stiffness.

In this embodiment of the present invention a vibration damping layer 62 is placed immediately adjacent and bonded to the thermal barrier coating applied to the interior surfaces. The vibration damping layer 62 is bonded to and surrounds a rigid core 64.

The core 64 is a relatively high modulus and low density material and is therefore relatively light weight. A preferable material is Bisphenol A-Epochlorohydrin mixed with an aliphatic polyamine and a suitable quantity of density-reducing glass or polymer microbubbles. It is preferable for the glass transition temperature of this material to be above 50° C. and a suitable proprietary product is Epocast 1637▩, which is available from Vantico▩, UK. There are many other usable materials for the core 64, all of which may have their density reduced with microbubbles and are known as syntactic material. These syntactic material may be strengthened using glass, carbon or aramid fibres.

It is desirable for the damping layer 62 to comprise a modulus of elasticity in the range 0.5-100 MPa and the modulus of elasticity of the core 64 to be above 200 MPa, but preferably at least 500 MPa and as much as 10000 MPa. For the polymer blend damping layer, described above, the modulus is approximately 10 MPa and a Poisson's ratio of approximately 0.45 and for the core (Epocast 1637▩) 700 MPa and 0.40 respectively.

Figure 6:
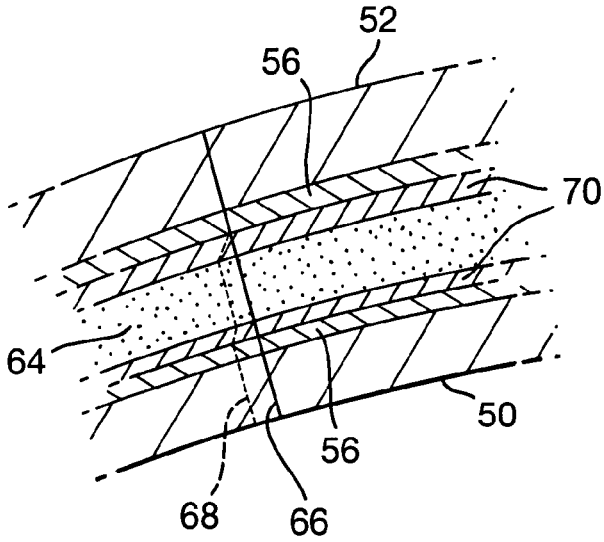
FIG. 6 is an enlargement of part of the cross-sectional view of a fan blade in accordance with a second embodiment of the present invention.

In operation of the turbofan gas turbine engine 10 the vibration damping material 57 damps the vibrations of the fan blade 26 by removing energy from the vibrations because of its viscoelasticity. It is known that there are many different modes of vibration experienced by a fan blade 26; however, all vibrations cause the blade 26 to bend in flexure. During flexure, at least part of each the concave and convex walls 50, 52 displace relative to one another in shear and this is shown in more detail in FIG. 6. Here it can be seen how an arbitrary datum or non-displaced line 66 is transformed to the dashed shear displaced line 68. Thus the vibrations of the fan blade 26 create shear strains that are transmitted substantially through the vibration damping layer 70, between the core 64 and the wall portions 50, 52. These shear strains cause a proportion of the energy of vibration to be transmitted, or lost, as heat energy thereby damping vibrations of the fan blade 26. As the vibration damping layer 70 is relatively thin it can be of a relatively high density material than the prior art teaches, as its total parasitic weight is significantly less.

For a fan blade 26 suitable for use in a Trent▩ series aerospace engine as made by Rolls-Royce▩ plc, the vibration damping layer 62 is 1.0 mm thick and comprises a density of 1.1 grams/cc, whereas the stiffenning core is 25 mm thick and 0.47 grams/cc. However, the layer thicknesses will be suited to both fan blade 26 characteristics such as frequency modes and blade size.

The fan blade 26 is manufactured generally as described in GB2371095, and the teaching of which are incorporated herein. The method has a number of steps including: forming at least two metal workpieces, applying stop off material to a predetermined area of a surface of at least one of the at least two metal workpieces, arranging the workpieces in a stack such that the stop off material is between the at least two metal workpieces, heating and applying pressure across the thickness of the stack to diffusion bond the at least two workpieces together in areas other than the preselected area to form an integral structure, heating and internally pressurising the interior of the integral structure to hot form the at least two metal workpieces into an aerofoil shape to form a turbomachine blade having a hollow interior defined by at least one internal surface.

The stop off material is preferably a plasma sprayed, yttria coating deposited to layer having a thickness of the order 200 microns or above. This is a significantly greater layer thickness than used in a conventional process, which has at most a thickness of the order 20 microns. In this method the stop off will also form the thermal barrier coating and is applied with masking so that only the future blade internals are coated. The plasma spray is set to give an open porous structure with the yttria as loosely fused platelets.

To prevent the coatings on opposing surfaces fusing during the diffusion bonding cycle a leachable inter-layer is applied. Preferably a low carbon steel shim, leachable in nitric acid, is preferred. The shim is single skin, though multiple skins may be used if large movement during the diffusion bonding process is expected. Beneficially the shim prevents the pores in the yttria coating from closing up completely and impairing insulation performance.

The porous nature of the yttria coating means that at the temperature of the diffusion bonding the titanium in the blade squeezes into interstices of the coating, which assists in mechanical keying of the coating with the internal surface of the blade and prevents break-off during operation.

After the fan blade 26 is allowed to cool the hollow interior of the fan blade is sequentially flushed with hot water to remove loose yttria particles and prepare the interior surfaces 58 and 60 for bonding to the viscoelastic material. Then the damping layer material 62 is supplied, through the pipe, into the hollow interior 54 of the fan blade 26 and against the interior surfaces 58 and 60 in a 1 mm thick layer. Preferably the damping layer material 62 is supplied through a pipe at the root end of the fan blade 26. The damping layer material 62 is allowed to cure in the fan blade 26 and to bond to the interior surfaces 58 and 60 of the hollow interior 54 of the fan blade 26. Once the damping layer 62 has cured the core 64 material is injected through the pipe. When the core 64 has cured the hollow interior 54 of the fan blade 26 is then sealed by welding across the pipe entry into the fan blade 26 to prevent the vibration damping and stiffening material 56 escaping from the fan blade 26.

Another method of placing the filler material is to inject both the damping layer and the core simultaneously through two coaxial tubes. The damping layer is injected through the outer tube and as it has a lower viscosity than the core, the more viscous core pushes the damping layer toward the interior walls.

In a second method the thermal barrier coating is a plasma sprayed, yttria stabilised $ZrO_2$ coating applied to the open surfaces. Yttria stabilised $ZrO_2$ has better thermal barrier properties than yttria alone, but does not offer such good properties as a stop off for use before diffusion bonding blade parts together.

Consequently it is desirable to deposit the coating after the blade has been bonded and preferably the coating is deposited through an electrophoretic deposition process. The yttria stabilised $ZrO_2$ particles are dispersed in a non polar organic liquid to form a colloidal suspension. The $ZrO_2$ particles are charged and an electric field between an electrode inserted into the cavity and the titanium walls of the aerofoil cause the particles to migrate and bond to the inner surfaces of the aerofoil. Yttria particles may also be deposited by electrophoresis.

In an alternative embodiment the thermal barrier coating is a polymer containing glass or ceramic beads. The glass beads are approximately 10 microns in diameter and the layer has a thickness between 1 and 1.5 mm. The beads constitute between 60 and 80% by volume of the thermal barrier coating and provide a low thermal conductivity of around 0.02 W/mK.

To manufacture this blade the thermal barrier coating is first applied to the inner surface of the aerofoil and cured or allowed to dry, depending on the polymer used, with the vibration damping material added subsequently. If necessary a stiffening core as described above may be used to improve the damping capability of the damping material.

Where the blade is part of a bladed disk, or blisk, there is a limitation in how such blades can be repaired in that it is not feasible to remove the blade and reattach it once repaired. Consequently, the blades must be repaired in-situ and thermally shielded from each other when a particular blade is being given a repair heat treatment so as not to reduce the life of adjacent blades by increased thermal exposure. The blades are located relatively close together and thermal shielding is difficult. The invention described herein enables the repair of damped blisks without damage to the viscoelastic damping material.

Although the invention has been described with reference to a fan blade 26 it is equally applicable to a compressor blade.

Although the invention has been described with reference to titanium alloy blades it is equally applicable to other metal alloy, metal or intermetallic blades.

We claim:

1. A turbomachine blade comprising a root portion and an aerofoil portion, the aerofoil portion having a leading edge, a trailing edge, a concave wall portion extending from the leading edge to the trailing edge and a convex wall portion extending from the leading edge to the trailing edge, the concave wall portion and the convex wall portion forming a continuous integral wall, the aerofoil portion having a hollow interior defined by at least one internal surface, the hollow interior of the aerofoil portion being at least partially filled with a vibration damping material having a decomposition temperature and which is separated from the wall portions by a thermally insulating material that inhibits decomposition of the vibration damping material when the blade is subject to a localised heat treatment at a temperature in excess of the decomposition temperature of the vibration damping material.

2. A blade according to claim 1, wherein the vibration damping material comprises a polymer.

3. A blade according to claim 2, wherein the polymer is a polymer blend comprising Bisphenol A-Epochlorohydrin, an amine hardener and branched polyurethane.

4. A blade according to claim 2, wherein the polymer comprises a liquid crystal siloxane polymer.

5. A blade according to claim 1, wherein the thermally insulating material is yttria or a yttria stabilised Zirconia Oxide.

6. A blade according to claim 1, wherein the thermally insulating material has a thickness of between 100 and 500 microns.

7. A blade according to claim 1, wherein the vibration damping material comprises a damping layer and a stiffening core, the damping layer being disposed between the thermally insulating material and the stiffening core.

8. A blade according to claim 7, wherein the damping layer is between 0.05 mm and 3.0 mm thick.

9. A blade according to claim 7, wherein the damping layer has a modulus between 0.5 $N/mm^2$ and 100 $N/mm^2$.

10. A blade according to claim 1 wherein the blade is a compressor blade or a fan blade.

11. A blade according to claim 1, wherein the convex and concave wall portions comprise titanium or titanium alloy.

12. A blade according to claim 1, wherein the thermally insulating material inhibits decomposition of the vibration damping material when the blade is subject to a localised heat treatment at a temperature between 400° C. and 700° C.

13. A gas turbine engine comprising a turbomachine blade as claimed in claim 1.

14. A method of manufacturing a turbomachine blade from at least two metal workpieces comprising the steps of:—

(a) forming at least two metal workpieces, (b) applying stop off material to a predetermined area of a surface of at least one of the at least two metal workpieces, (c) arranging the workpieces in a stack such that the stop off material is between the at least two metal workpieces, (d) heating and applying pressure across the thickness of the stack to diffusion bond the at least two workpieces together in areas other than the preselected area to form an integral structure, (e) heating and internally pressurising the interior of the integral structure to hot form the at least two metal workpieces into an aerofoil shape to form a turbomachine blade having a hollow interior defined by at least one internal surface, (f) supplying vibration damping material into the hollow interior of the turbomachine blade and bonding the vibration damping to the stop off material, and (g) sealing the hollow interior of the turbomachine blade.

15. A method according to claim 14, wherein the stop off material is yttria stabilised Zirconia Oxide.

* * * * *